US006922132B2

(12) United States Patent
Montante

(10) Patent No.: US 6,922,132 B2
(45) Date of Patent: Jul. 26, 2005

(54) FUSE CUTOUT WITH IMPROVED DROPOUT PERFORMANCE

(75) Inventor: Jorge R. Montante, Cicero, IL (US)

(73) Assignee: S & C Electric Co., Chicago, IL (US)

( * ) Notice: Subject to any disclaimer, the term of this patent is extended or adjusted under 35 U.S.C. 154(b) by 0 days.

(21) Appl. No.: 10/959,327

(22) Filed: Oct. 5, 2004

(65) Prior Publication Data

US 2005/0104709 A1 May 19, 2005

Related U.S. Application Data

(63) Continuation of application No. PCT/US03/12449, filed on Apr. 14, 2003.

(60) Provisional application No. 60/375,800, filed on Apr. 26, 2002, and provisional application No. 60/377,516, filed on May 3, 2002.

(51) Int. Cl.[7] ..... H01H 85/42; H01H 85/20

(52) U.S. Cl. ..... 337/174; 337/171; 337/172

(58) Field of Search ..... 337/171–181, 337/186, 187, 207, 208, 211; 29/623

(56) References Cited

U.S. PATENT DOCUMENTS 4,317,099 A * 2/1982 Sabis ..... 337/170
4,326,184 A * 4/1982 Murdock ..... 337/168
4,546,341 A * 10/1985 McNaghten et al. ..... 337/177
4,768,010 A * 8/1988 Brown et al. ..... 337/169
5,463,366 A * 10/1995 Hassler et al. ..... 337/176
5,566,423 A * 10/1996 Hassler et al. ..... 16/319

FOREIGN PATENT DOCUMENTS

EP 593162 A1 * 4/1994 ..... H01H/85/042
EP 676788 A2 * 10/1995 ..... H01H/85/042

* cited by examiner

*Primary Examiner*—Anatoly Vortman
(74) *Attorney, Agent, or Firm*—James V. Lapacek

(57) ABSTRACT

An improved fuse cutout is provided of the type having a fuse tube assembly that moves to a dropout position upon operation in response to a fault current or other overcurrent. These types of fuse cutouts include the pivotal mounting of the fuse tube assembly with respect to a support hinge with the fuse tube assembly being released for pivotal movement to the dropout position when the fuse cutout has operated. The fuse tube assembly includes a collapsible toggle joint that collapses upon operation of the fuse cutout. The improved fuse cutout includes additional dropout assistance that is provided via a resilient member operating between the components of the collapsible toggle joint to apply a force to assist the collapse of the toggle joint.

5 Claims, 3 Drawing Sheets

40
36
32
45
44
42
52
26
48
54
22
24
30
16
14
12
50
48
58
60
56
62
70
28
72
78
76
68
64
81
80
20
66
75
74
82

FUSE CUTOUT WITH IMPROVED DROPOUT PERFORMANCE

This application is a continuation of application Ser. No. PCT/US03/12449 filed on Apr. 14, 2003 which claims the benefit of U.S. Provisional Application Nos. 60/375,800 filed Apr. 26, 2002 and 60/377,516 filed May 3, 2002.

BACKGROUND OF THE INVENTION

1. Field of the Invention

The present invention relates to an improved fuse cutout and, more particularly, to an improved fuse cutout that has increased dropout characteristics and operating performance. The improved fuse cutout of the present invention is of the type shown in S&C Electric Co. Descriptive Bulletin 351-30, dated Dec. 7, 1998, entitled "S&C Type XS Fuse Cutouts" and in U.S. Pat. Nos.: 2,553,098; 2,745,923 and 4,414,527. This type of fuse cutout may be used with a fuse link of the type sold by S&C Electric Co. as the Positrol® Fuse Link and as generally shown in U.S. Pat. Nos. 4,317,099.

2. Discussion of the Prior Art

Fuse cutouts and fuse links utilized therein are well known. A typical fuse cutout includes a hollow insulative fuse tube having conductive ferrules mounted to the opposite ends thereof. One ferrule (often called the "exhaust" ferrule) is located at an exhaust end of the fuse tube and usually includes a trunnion which interfits with a trunnion pocket or hinge of a first contact assembly carried by one end of an insulator. The other ferrule is normally held and latched by a second contact assembly carried by the other end of the insulator so that the fuse tube is normally parallel to, but spaced from, the insulator. The insulator is mountable to the cross-arm of a utility pole or a similar structure. The fuse link is located within the fuse tube with its ends respectively electrically continuous with the ferrules. One point of an electrical circuit is connected to the first contact assembly, while another point of the circuit is connected to the second contact assembly. Often, the insulator and the fuse tube are oriented generally perpendicular to the ground so that the exhaust ferrule and the first contact assembly are located below the other ferrule and the second contact assembly. The fuse tube may include a high burst strength outer portion—for example, a fiber-glass-epoxy composite having an arc-extinguishing material within the inner portions thereof. Normal currents flowing through the electrical circuit flow without affecting the fuse link. Should a fault current or other overcurrent, to which the fuse link is designed to respond, occur in the circuit, the fuse link operates as described in more detail hereinafter.

Operation of the fuse link permits the upper ferrule to disengage itself from the upper contact assembly, whereupon the fuse tube rotates downwardly due to coaction of the trunnion and the hinge. If the fuse link operates properly, current in the circuit is interrupted and the rotation of the fuse tube gives a visual indication that the cutout has operated to protect the circuit, e.g. dropout operation to a so-called dropout position. Typical fuse links include a first terminal and a second terminal, between which there is normally connected a fusible element made of pure silver, silver-tin, or the like. Also connected between the terminals may be a strain wire, for a purpose described below. The second terminal is electrically continuous with, and is usually mechanically connected to, a button assembly, which is engagable by a portion of the upper ferrule on the fuse tube. The first terminal is connected to a flexible, stranded length of cable. Surrounding at least a portion of the second terminal, the fusible element, the strain wire (if used), the first terminal, and some portion of the flexible stranded cable is a sheath. The sheath is typically made of a so-called ablative arc-extinguishing material which, when exposed to the heat of a high-voltage arc, ablate to rapidly evolve large quantities of deionizing turbulent and cooling gases. Typically, the sheath is much shorter than the fuse tube and terminates short of the exhaust end of the fuse tube.

The free end of the stranded cable exits the fuse tube from the exhaust end thereof and has tension or pulling force maintained thereon by a spring-loaded flipper on the trunnion. The tension or pulling force exerted on the cable by the flipper attempts to pull the cable and the first terminal out of the sheath and out of the fuse tube. The force of the flipper is normally restrained by the strain wire, typical fusible elements not having sufficient mechanical strength to resist this tension or pulling force.

In the operation of typical cutouts, a fault current or other over-current results, first, in the melting or vaporization of the fusible element, followed by the melting or vaporization of the strain wire. Following such melting or vaporization, a high-voltage arc is established between the first and second terminals within the sheath and the flipper is now free to pull the cable and the first terminal out of the sheath and, ultimately, out of the fuse tube. As the arc forms, the arc-extinguishing materials of the sheath begin to ablate and high quantities of de-ionizing, turbulent and cooling gases are evolved. The movement of the first terminal under the action of the flipper, and the subsequent rapid movement thereof due to the evolved gases acting thereon as on a piston, results in elongation of the arc. The presence of the de-ionizing, turbulent and cooling gas, plus arc elongation, may, depending on the level of the fault current or other over-current, ultimately result in extinction of the arc and interruption of the current at a subsequent current zero. The loss of the tension on the stranded cable permits the trunnion to experience some initial movement relative to the exhaust ferrule which permits the upper ferrule to disengage itself from the upper contact assembly. This initiates a downward rotation of the fuse tube and its upper ferrule to a so-called "dropout" or "dropdown" position.

As noted above, arc elongation within the sheath and the action of the evolved gases may extinguish the arc. At very high fault current or over-current levels, however, arc elongation and the sheath may not, by themselves, be sufficient to achieve this end. Simply stated, at very high fault current levels, either the sheath may burst (because of the very high pressure of the evolved gas) or insufficient gas may be evolved therefrom to quench the high current level arc. For these reasons, the fuse tube is made of, or is lined with, ablative arc-extinguishing material. In the event the sheath bursts, the arc-extinguishing material of the fuse tube interacts with the arc, with gas evolved as a result thereof achieving arc extinction. If the sheath does not burst, the arc-extinguishing material of the fuse tube between the end of the sheath and the exhaust end of the fuse tube is nevertheless available for evolving gas, in addition to that evolved from the sheath. The joint action of the two quantities of evolved gas, together with arc elongation, extinguish the arc.

When a fuse tube is properly positioned between the upper and lower contact assemblies of the mounting, the contacts of the fuse tube are firmly engaged within the contact assemblies of the mounting. When the fuse link operates, gases evolved within the fuse tube thrust it against the upper contact assembly of the mounting. Ideally, the contact cap should not disengage the concavity until the fusible elements of the fuse link completely melts to release the tension in the cable and until the initial thrust of the fuse tube subsides. Release of this tension and subsiding of fuse tube thrust permits a limited amount of relative movement between the exhaust ferrule and the trunnion about a toggle joint therebetween. This limited movement permits the contact cap to move out of the concavity and the fuse tube to begin movement toward the dropout position due to rotation of the trunnion in the hinge pocket. If the fuse tube moves too far transversely during its thrusting, the contact cap may disengage the concavity too early. Third, transverse movement of the fuse tube can apply a bending movement thereon. This bending movement can fracture the fuse tube near the exhaust ferrule. Corrosion that builds up on various parts and dimensional changes of the fuse tube or fuse link sheath, e.g. due to environmental factors, can exacerbate the proper dropout action.

Thus, it is important for achieving proper operation as explained above that dropout operation be readily achieved in spite of any deleterious operating environments or conditions.

SUMMARY OF THE INVENTION

Accordingly, it is a principal object of the present invention to provide a cutout with improved dropout performance.

This and other objects of the present invention are achieved by an improved fuse cutout of the type having a fuse tube assembly that moves to a dropout position upon operation in response to a fault current or other overcurrent. These types of fuse cutouts include the pivotal mounting of the fuse tube assembly with respect to a support hinge with the fuse tube assembly being released for pivotal movement to the dropout position when the fuse cutout has operated. The fuse tube assembly includes a collapsible toggle joint that collapses upon operation of the fuse cutout. The improved fuse cutout includes additional dropout assistance that is provided via a resilient member operating between the components of the collapsible toggle joint to apply a force to assist the collapse of the toggle joint.

DETAILED DESCRIPTION

Figure 1:
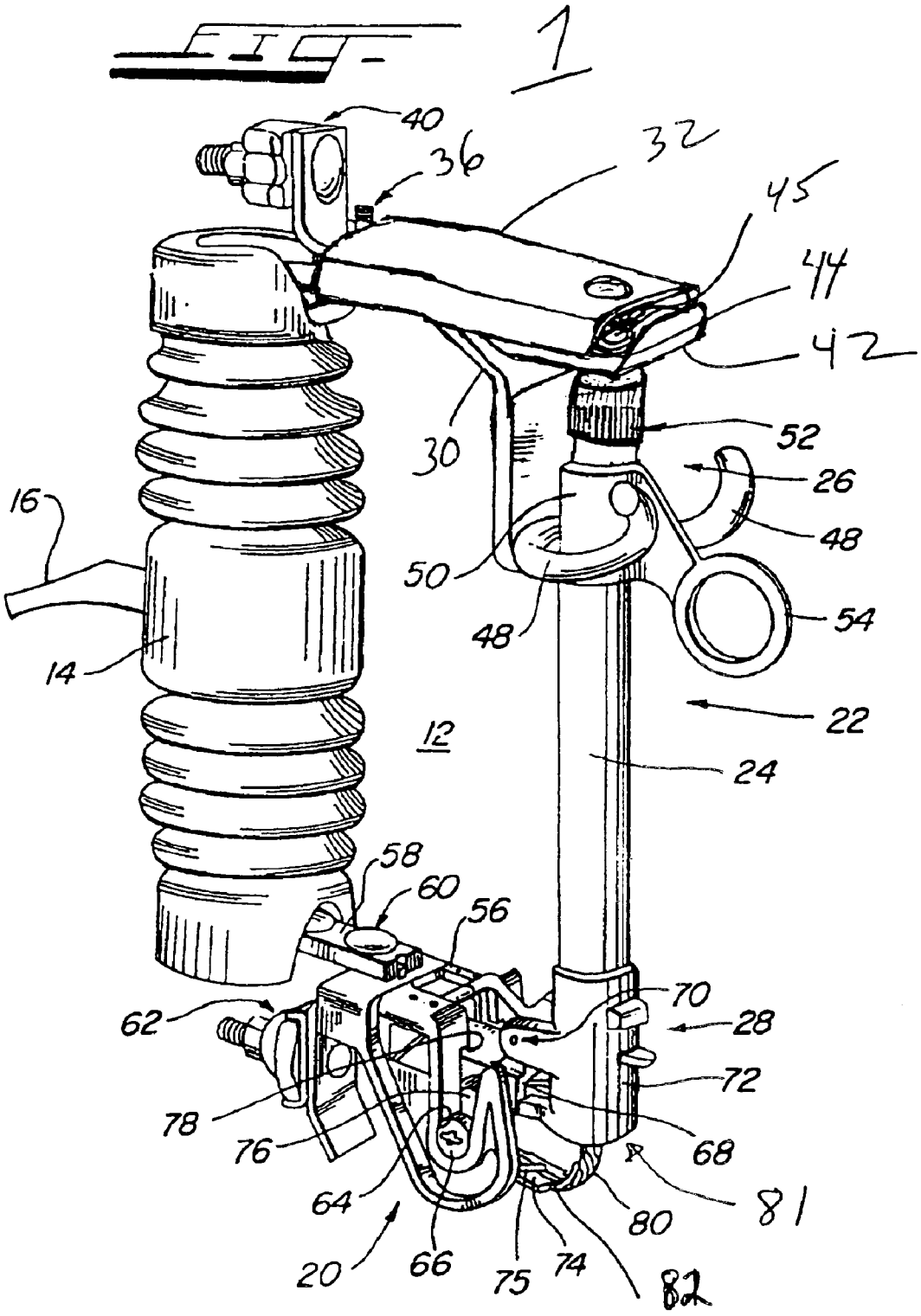
FIG. 1 is a perspective view of an improved fuse cutout according to the present invention.
Figure 2:
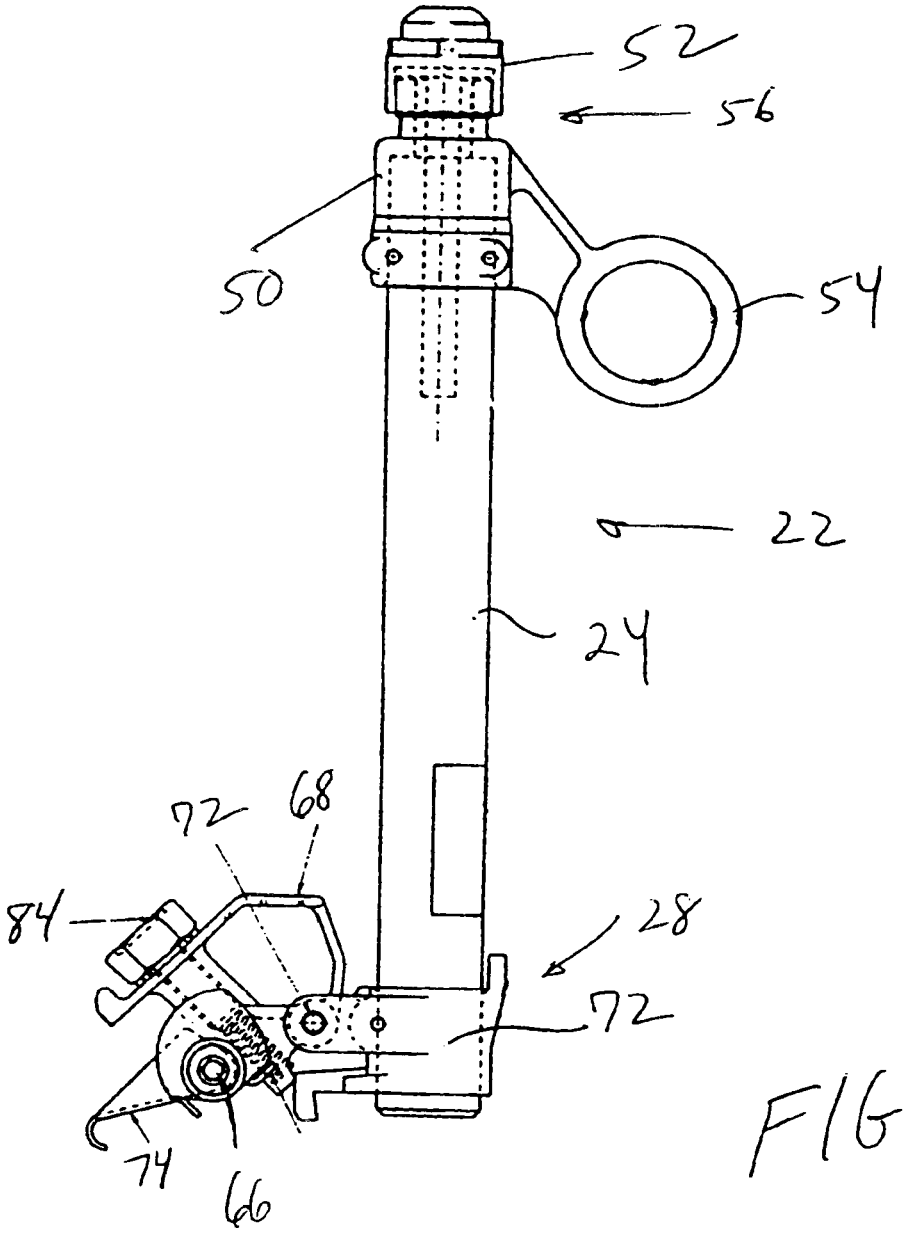
FIG. 2 is an elevational view of a fuse tube assembly of the cutout of FIG. 1.

Referring first to FIG. 1, there is shown an improved cutout 12 according to the present invention that includes an insulator 14 and a mounting member 16 extending therefrom. The mounting member 16 permits mounting of the insulator 14 and the fuse cutout 12 to an upright or a crossarm of a utility pole or the like (not shown). Affixed to the upper end of the insulator 14 is an upper contact assembly generally designated 18. Further, affixed to the lower end of the insulator 14 is a lower contact assembly 20. The cutout 12 also includes a fuse tube assembly 22 (also shown in FIG. 2) that in the normal, circuit-connected or unoperated condition of the cutout 12 may be maintained in the generally vertical position shown in FIG. 1, e.g. cutouts are typically mounted at a slight angle to the vertical.

Considering now more specific features of the fuse tube assembly 22, the fuse tube assembly includes an insulative fuse tube 24 of a well-known type, which may comprise an epoxy-fiber-glass composite outer shell lined with an arc-extinguishing material. Mounted or affixed to the upper end of the fuse tube 24 is an upper ferrule assembly 26, while at the opposite lower or exhaust end of the fuse tube 24 is a lower or exhaust ferrule assembly 28. In the position of the fuse tube assembly 22 depicted in FIG. 1, the lower ferrule assembly 28 is held by the lower contact assembly 20, while the upper ferrule assembly 26 is held, and latched against movement, by the upper contact assembly 18.

The upper contact assembly 18 includes a support bar 30 and a recoil arm and contact hood 32 which runs generally parallel to a portion of the support bar 30. Near the top of the insulator 14, the bar 30 and the arm 32 are mounted by a fastener or the like at 36 to a portion of a connector assembly 40 that is affixed to the top of the insulator 14. The connector assembly 40 facilitates the connection to the upper contact assembly 18 to a cable or conductor of a high-voltage circuit.

The upper contact assembly 18 also includes a spring contact arm 42 and a backup spring 44 that is positioned between the spring contact arm 42 and the recoil arm and contact hood 32, e.g. the backup spring 44 is positioned at one end over a convexity 45 extending from the top of the contact arm 42 and at the other end over a convexity (not shown) extending downwardly from the recoil arm and contact hood 32. The backup spring 44 provides high contact pressure between the contact arm 42 and the top of the fuse tube assembly 24 as will be explained in more detail hereinafter. As is typical in the power industry, the support bar 30 at a downwardly bent portion 35 includes attachment hooks 48 for cooperation with a portable loadbreak tool.

The upper ferrule assembly 26 of the fuse tube assembly 24 includes a ferrule 50 affixed to the upper end of the fuse tube 24. The ferrule 50 typically includes a threaded portion (not shown) onto which is threaded a contact cap 52. The contact cap 52 is configured so as to fit into and be held when the fuse tube assembly 22 is in the position shown in FIG. 1, e.g., by an indentation or concavity (not shown) formed in the spring contact 42 opposite the convexity 45. The ferrule 50 typically also includes a pull ring 54. The pull ring 54 may be engaged by a hook stick or the like to move the upper ferrule assembly 26 away from the upper contact assembly 18 while the lower ferrule assembly 28 rotates in the lower contact assembly 20, as described hereinafter.

In view of the nature of high voltage circuits, this opening movement of the fuse tube assembly 22 must be effected while the circuit connected to the cutout 10 is de-energized or else an arc will form between the upper ferrule assembly 26 and the upper contact assembly 18. The fuse tube assembly 22 may also be opened by initially attaching between the attachment hooks 48 and the pull ring 54 a portable loadbreak tool. Such a portable loadbreak tool permits the fuse tube assembly 22 to be opened with the circuit energized, momentarily having transferred thereto the flow of current in the circuit 10 and interrupting such current internally thereof.

Figure 3:
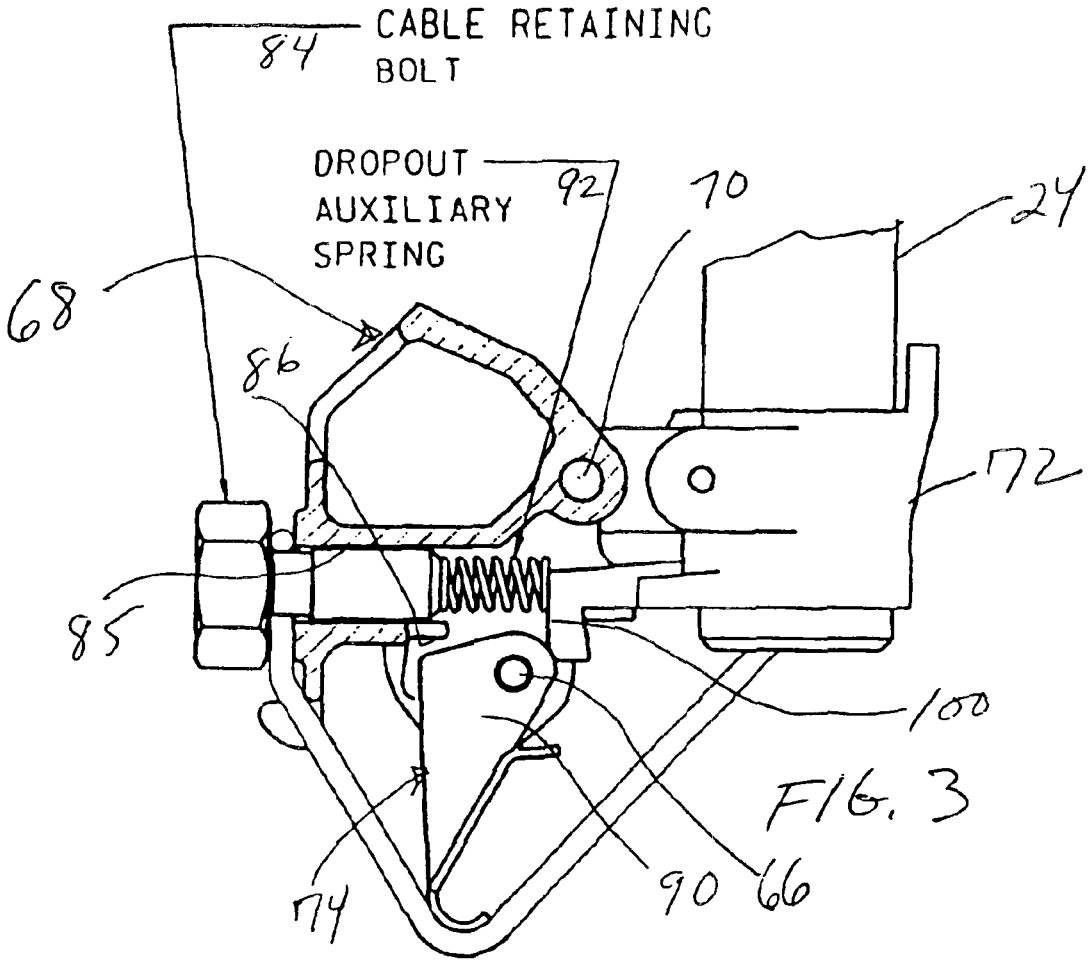
FIG. 3 is an enlarged, partial view of the fuse tube assembly of FIG. 2 in an operative position.

The lower contact assembly 20 includes a support member 56 attached to a mount 58 by a fastener or the like at 60. The support member 56 carries a connector 62, such as a parallel groove connector, to facilitate connection of the lower contact assembly 20 to another cable or conductor of the high-voltage circuit in which the fuse cutout 12 is to be used. The support member 56 provides a hinge function via trunnion pockets 64. The trunnion pockets are designed to cooperate with and hold outwardly extending portions 66 of a trunnion 68 (also shown in FIG. 3) carried by the fuse tube 24. Specifically, a lower ferrule 72 affixed to the fuse tube 24 pivotally mounts the trunnion 68 at a toggle joint 70. Thus, the trunnion 68 functions as a toggle member and defines a double pivot mounting for the fuse tube 24, the first pivot being defined at the toggle joint 70 and the second pivot being defined by the extending portions 66 of the trunnion 68 within the trunnion pockets 64 of the hinge support member 56.

As hereinafter described, the trunnion 68 and the ferrule 72 are normally rigidly held in the relative position depicted in FIG. 1. In this normal relative position of the trunnion 68 and the ferrule 72, the contact cap 52 is engaged by the spring contact 42 to maintain the fuse tube assembly 22 in the position depicted in FIG. 1. Also, as described in more detail below, when a fuse link (not shown) within the fuse tube 24 operates, the trunnion 68 and the ferrule 72 are no longer rigidly held, and the ferrule 72 may rotate downwardly relative to the trunnion 68 about the toggle joint 70. This movement of the ferrule 72 permits the contact cap 52 to disengage the spring contact 42, following which the entire fuse tube assembly 22 rotates about the lower contact assembly 20 via rotation of the extending portions 66 in the trunnion pockets 64. Considering additional structural features, rotatably mounted to the trunnion 68 is a flipper 74. A spring 75 mounted between the trunnion 68 and the flipper 74 biases the flipper 74 away from the lower or exhaust end of the fuse tube 24. The trunnion 68 includes shoulders 76 or other similar features. The support member 56 also includes features, such as shoulders 78, normally spaced from the shoulders 76 when the extending portions 66 of the trunnion 68 are seated in their respective trunnion pockets 64. The normal spacing between the shoulders 76 and 78 is sufficient to permit appropriate movement of the fuse tube 24 with respect to the lower contact assembly 20 during operation as explained hereinafter.

Figure 4:
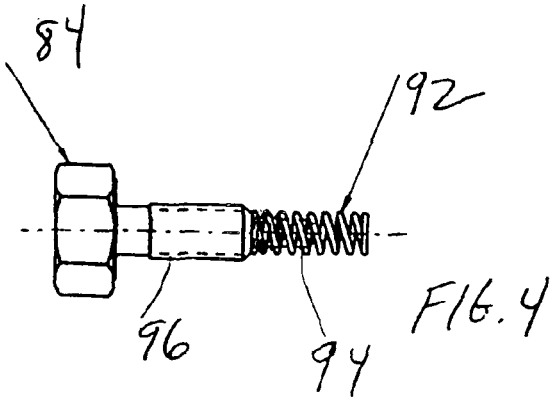
FIG. 4 is an enlarged elevational view of a dropout assist member of the cutout of FIGS. 1–3.

In use, a fuse link is first installed into the fuse tube assembly 22. Suffice it here to say that the contact cap 52 is removed and the fuse link is inserted into the interior of the fuse tube 24 from the upper end thereof. A portion of the fuse link abuts a shoulder (not shown) at the top of the ferrule 50, following which the contact cap 52 is threaded back onto the ferrule 50. Reference may be made to S&C Electric Co. Instruction Sheet 351-500 and the aforementioned patents for additional information and details. A flexible stranded cable 80 forming a part of the fuse link exits an exhaust opening at 81 in the lower or exhaust end of the fuse tube 24. The flipper 74 is manually rotated against the action of the spring 75 to position it adjacent the exhaust opening at 81 following which the cable 80 is laid into a channel at 82 in the flipper 74. Following this, the cable 80 is wrapped around a flanged bolt 84 (shown in FIGS. 2–4) that is threaded into the trunnion 68 via a threaded portion 85. Following tightening of the flanged bolt 84 to hold the cable 80, the flipper 74 is maintained against the bias of the spring 75 in the position shown in FIG. 1, whereat there is a constant tension force applied to the cable 80 and the remainder of the fuse link within the fuse tube 24. It is this connection of the cable 80 to the trunnion 68 by the flanged bolt 84 and the action of the spring 75 on the flipper 74 that normally holds the trunnion casting 68 and the ferrule 72 in the position depicted in FIG. 1 relative to the toggle joint 70.

Following operation of a fuse link within the fuse tube 24, the flipper 74 is able to move the cable 80 downwardly within the fuse tube 24. The release of the tension force applied to the cable 80 by the flipper 74 permits relative movement of the ferrule 72 and the trunnion 68 about the toggle joint 70 to permit separation of the contact cap 52 from the spring contact 42. The relative movement of the ferrule 72 and the trunnion 68 occurs after tension in the cable 80 is released and after an initial upward thrust of the fuse tube 24 subsides. As more fully explained in the aforementioned patents, when a fusible element (not shown) of the fuse link within the fuse tube 24 melts, there follows the rapid evolution of arc-extinguishing gas within the fuse tube 24. This evolved gas exits the exhaust opening at 81 of the fuse tube 24 at a very rapid rate, thrusting the fuse tube 24 upwardly.

When the fuse link operates, the tension on the cable 80 is released at the same time the fuse tube 24 thrusts up. While the relative movement of the trunnion 68 with respect to the ferrule 72 and about the toggle joint 70 does not immediately occur simultaneously with the rapid gas exhaust, it is able to occur shortly thereafter in response to the release of tension in the cable 80. This relative movement permits the contact cap 52 to disengage from the contact arm 42 and the fuse tube assembly 22 to rotate to a "dropout" position via rotation of the extensions 66 of the trunnion 68 in the trunnion pockets 64. All of the above is "timed" so that rotation of the fuse tube assembly 22 is initiated as or after the fuse link has interrupted current in the circuit.

There is a tendency for frictional resistance caused by corrosion, contamination or sleet such that the trunnion 68 may not be able to pivot about the hinge support member 56. If that should occur, the fuse tube 24 would remain in place and not dropout, thus not providing the desirable and necessary air gap to prevent leakage over the fuse tube 24. To this end, an anvil surface 86 is provided on the lower surface of the trunnion 68 that is engaged by the upper edges 88 of the spaced sidewalls 90 of the flipper 74. Thus, the impact of the flipper 74 as well as the action of the spring 75 act to assist in pivoting the trunnion 68 about the toggle joint 70. In some circumstances it may be desirable and/or necessary to further improve the dropout performance, especially where 1. the fuse link or fuse tube components might experience dimensional changes due to environmental factors and/or 2. where the cutout mounting and fuse tube assembly are from different manufacturers which may not be ideally suited to work with each other, i.e. the interfacing, cooperating components are not identical to those for which they were designed.

In accordance with important aspects of the present invention, additional dropout assistance is provided via a spring 92 carried about the shaft of the bolt 84, e.g. the shaft of the bolt 84 having a narrowed portion 94 beyond the wider, threaded shaft portion 96. Ina specific embodiment, the narrowed portion 94 includes a threaded portion 98 for affixing the spring 92 to the bolt 84. The spring 92 is compressed when the bolt 84 is threaded into the trunnion 68 and tightened to hold the cable 80. The spring 92 is compressed against an extending tab 100 of the ferrule 72 of the lower ferrule assembly 28. Accordingly, when the fuse operates and the cable 80 is released, the spring 92 acts to directly rotate the trunnion 68 about the toggle joint 70 to assist in the dropout action of the fuse tube assembly 22. It should be noted that this assist action is more positive than that of the pivoting of the trunnion 68 due to its being released and also over a wider range and time than that of the release of the flipper 74.

Accordingly, the bolt 84 with the spring 92 as an overall assembly 104 performs a dropout assistance function and also functions to retain or clamp the cable 80 to maintain the fuse tube assembly within the upper and lower contact assemblies 18 and 20. It should also be noted that since every fuse cutout of the type 12 utilizes a bolt such as 84 to clamp the cable 80, the dropout assistance assembly 104 is capable of easy retrofit in the field merely by substituting the dropout assistance assembly 104 for the conventional bolt for clamping the cable 80. Further, the desired additional dropout assistance is variable in specific embodiments via the selection of the resilient characteristics of the spring 92. It will also be clear to those skilled in the art that the leading surface of the spring 92 and/or the extending tab 100 of the ferrule 72 of the lower ferrule assembly 28 should be prepared and/or finished so as to provide unfettered rotation of the spring 92 when tightening the bolt 84 during installation of the fuse link as well as reliable disengagement thereof during operation of the fuse cutout 12.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed is:

1. In a dropout fuse assembly wherein a fuse tube containing a fuse link is held by a latch arrangement to interconnect upper and lower line terminals, the lower line terminal having a support arrangement associated therewith, in combination, a toggle member or pivoting on the support arrangement and on the lower end of the fuse tube for lowering it to disengage the latch arrangement and permit the fuse tube to swing downwardly to a dropout position, a flipper pivoted on the toggle member and adapted to be restrained by the fuse link, a spring biasing the flipper for withdrawing from the fuse tube the portion of the fuse link released on operation thereof, and dropout assist means acting between the toggle member and the fuse tube for biasing the toggle member for pivoting for lowering and disengaging the latch arrangement.

2. The combination of claim 1 wherein said dropout assist means comprises a resilient member.

3. The combination of claim 2 further comprising a bolt for clamping the fuse link in to the toggle member, said dropout assist means being carried by said bolt.

4. In a dropout fuse assembly wherein a fuse tube containing a fuse link is held by a latch arrangement to interconnect upper and lower line terminals, the lower line terminal having a support arrangement associated therewith, a toggle member or pivoting on the support arrangement and on the lower end of the fuse tube for lowering it to disengage the latch arrangement and permit the fuse tube to swing downwardly to a dropout position, a flipper pivoted on the toggle member and adapted to be restrained by the fuse link, a spring biasing the flipper for withdrawing from the fuse tube the portion of the fuse link released on operation thereof, a first bolt for clamping the fuse link in to the toggle member, an arrangement for retrofitting the dropout fuse assembly with enhanced dropout facilities via the replacement of the first bolt with a second bolt and a resilient member carried by said second bolt for acting between the toggle member and the fuse tube and for biasing the toggle member for pivoting for lowering and disengaging the latch arrangement.

5. A method for retrofitting a dropout fuse assembly with enhanced dropout facilities, the dropout fuse assembly including a fuse tube containing a fuse link being held by a latch arrangement to interconnect upper and lower line terminals, the lower line terminal having a support arrangement associated therewith, a toggle member or pivoting on the support arrangement and on the lower end of the fuse tube for lowering it to disengage the latch arrangement and permit the fuse tube to swing downwardly to a dropout position, a flipper pivoted on the toggle member and adapted to be restrained by the fuse link, a spring biasing the flipper for withdrawing from the fuse tube the portion of the fuse link released on operation thereof, a first bolt for clamping the fuse link in to the toggle member, the method comprising retrofitting the dropout fuse assembly via the replacement of the first bolt with a second bolt and a resilient member carried by said second bolt for acting between the toggle member and the fuse tube and for biasing the toggle member for pivoting for lowering and disengaging the latch arrangement.

* * * * *